US009033690B2

(12) United States Patent
Alecu et al.

(10) Patent No.: US 9,033,690 B2
(45) Date of Patent: May 19, 2015

(54) SCAVENGE GEAR PUMP

(75) Inventors: Daniel Alecu, Toronto (CA); Pierre Gauvin, Saint-Bruno (CA); Ritchie Domingo, Markham (CA)

(73) Assignee: Pratt & Whitney Canada Corp., Longueuil (CA)

( * ) Notice: Subject to any disclaimer, the term of this patent is extended or adjusted under 35 U.S.C. 154(b) by 153 days.

(21) Appl. No.: 13/484,538

(22) Filed: May 31, 2012

(65) Prior Publication Data

US 2013/0323104 A1 Dec. 5, 2013

(51) Int. Cl.
*F04C 2/18* (2006.01)
*F04C 15/00* (2006.01)

(52) U.S. Cl.
CPC ..... *F04C 2/18* (2013.01); *F04C 15/0019* (2013.01); *F04C 15/0034* (2013.01); *F04C 15/0088* (2013.01)

(58) Field of Classification Search
CPC ..... F04C 15/0053; F04D 1/12; F04D 9/001
USPC ..... 418/206, 15, 206.1, 206.4; 184/1
See application file for complete search history.

(56) References Cited

U.S. PATENT DOCUMENTS

| | | | | |
|---|---|---|---|---|
| 2,690,129 | A * | 9/1954 | Boeckeler | 417/83 |
| 3,788,426 | A * | 1/1974 | Hull, Jr. | 184/109 |
| 4,090,820 | A * | 5/1978 | Teruyama | 418/1 |
| 4,480,970 | A * | 11/1984 | Smith | 418/15 |
| 4,631,009 | A | 12/1986 | Cygnor et al. | |
| 5,004,407 | A | 4/1991 | Hutchison | |
| 6,012,646 | A | 1/2000 | Young et al. | |
| 7,094,042 | B1 | 8/2006 | Borgetti et al. | |
| 2007/0178003 | A1 * | 8/2007 | Zhu et al. | 418/206.1 |

* cited by examiner

*Primary Examiner* — Mary A Davis
*Assistant Examiner* — Paule Thiede
(74) *Attorney, Agent, or Firm* — Norton Rose Fulbright Canada LLP

(57) ABSTRACT

A scavenge gear pump and its method of operation is described. The scavenge gear pump includes a pump housing defining a pump chamber, an inlet passage, an outlet passage, and a fluid injection passage in fluid communication with the pump chamber. The inlet passage receives an admixed fluid at low pressure and the outlet passage the admixed fluid at high pressure from a downstream region of said pump chamber. The fluid injection passage receives a third fluid at an injection pressure for input into the pump chamber. A pair of driveable gears is disposed in the pump chamber. The third fluid is injected directly into the gear meshing area of the pump chamber through the fluid injection passage so that the third fluid fills voids at least between said intermeshing teeth of the driveable gears and so that the second fluid does not occupy the gear meshing area.

12 Claims, 5 Drawing Sheets

SCAVENGE GEAR PUMP

TECHNICAL FIELD

The present application relates to pumps and, more particularly, to scavenge gear pumps.

BACKGROUND ART

Scavenge gear pumps are utilized in all sorts of applications whereby to pump a liquid which is received at an inlet of the pump at a low pressure and wherein the gear pump progressively increases the pressure of the fluid to a higher pressure at an outlet end. The liquid can be oil such as used in hydraulic systems or in a lubricating system such as for a gas turbine engine. Other applications of scavenge gear pumps are well known in the art. The typical scavenge gear pump may carry an air-oil mixture which is composed of about 1 to 3 volume of air for each 1 volume of oil. The oil mixture separates in the pump due to the centrifugal forces wherein the oil is released at the tooth tip of the gears while the air forms a bubble towards the gear hub. Downstream of the pump air at a higher pressure becomes trapped in a downstream area and this air enters the meshing area of the teeth of the gears and is released back at the upstream end of the pump where the air expands due to the lower pressure in that area where the air occupies space. This air build-up causes the scavenge pump to stall and re-prime itself. Also, because of this effect, the pump housings are made larger due to this air displacement between the downstream end and the upstream end of the pump. Because of this air transfer in the pump housing, the efficiency of the pump is affected as well as the volumetric efficiency thereof wherein more space is required to handle the air displacement. Obviously, the pump also does not operate at a constant capacity.

SUMMARY

According to one aspect, there is provided a scavenge gear pump comprising a pump housing having a pump chamber in which is rotatably mounted a pair of driveable toothed gears. The pump chamber has an inlet passage for receiving oil having air bubbles therein at low pressure and an outlet passage for delivering the oil at a higher pressure. The gears have radially projecting gear teeth disposed closely spaced to a respective one of opposed arcuate walls of the pump chamber to define opposed convection paths. The gear teeth of the pair of toothed gears, intermesh in a gear meshing area between the gears. A downstream region is defined in the pump chamber between the outlet passage and the gear meshing area, and an upstream region is defined between the inlet passage and the gear meshing area. An oil nozzle is provided in the downstream region and is disposed in relation to the gear meshing area to inject oil under pressure in the gear meshing area and at a rate to occupy substantially all voids between the gear teeth in the gear meshing area to prevent the air bubbles in the downstream region to be displaced back into the gear meshing area.

According to another aspect, there is provided a method of increasing the volumetric efficiency and back pressure of a scavenge gear pump comprising the step of injecting oil under pressure in a downstream region of the pump adjacent a gear meshing area to substantially prevent the ingress of air bubbles, present in the downstream region, into the gear meshing area whereby substantially only oil is displaced by the intermeshing gears of the pump to an upstream region of the pump where an oil-air mixture enters the pump at an inlet thereof to be pressurized to the downstream region wherein a pump outlet is provided.

BRIEF DESCRIPTION OF THE DRAWINGS

Reference is now made to the accompanying figures in which.

DETAILED DESCRIPTION

Figure 1:
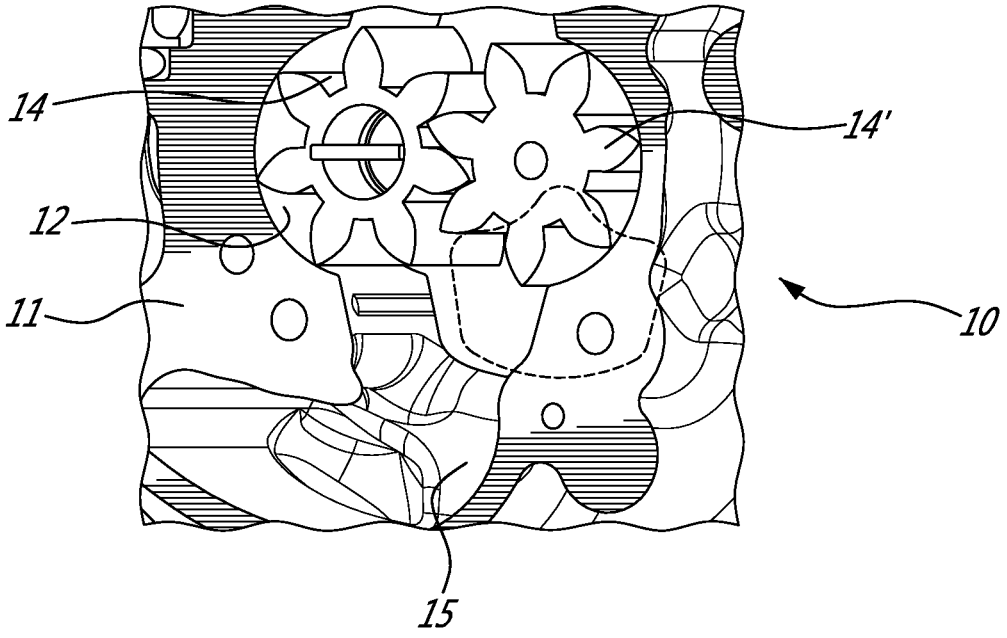
FIG. 1 is a fragmented perspective view illustrating the typical construction of a scavenge gear pump.
Figure 2C:
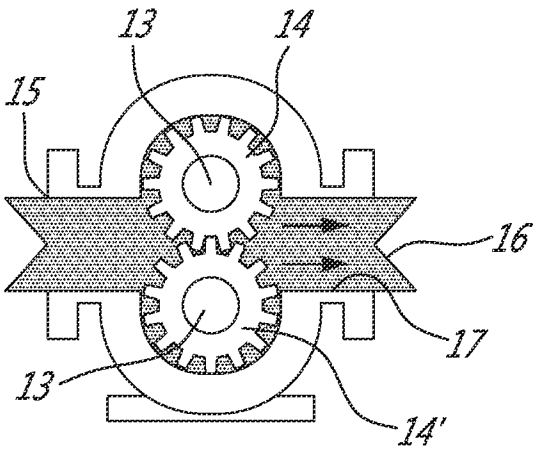
FIGS. 2A to 2C are cross-section views showing the operation of the typical scavenge gear pump shown in FIG. 1.
Figure 2B:
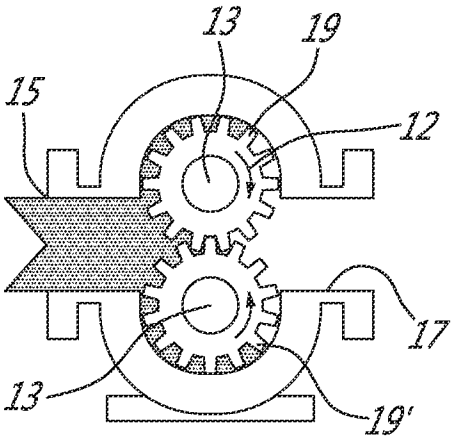
Figure 2A:
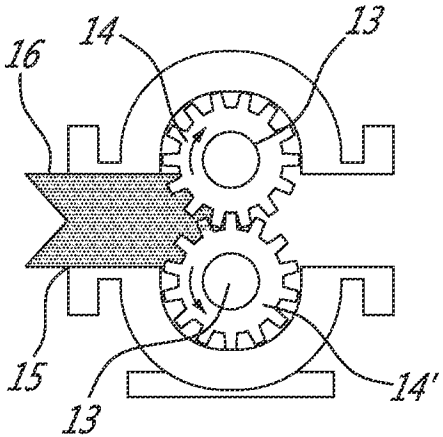
Figure 3:
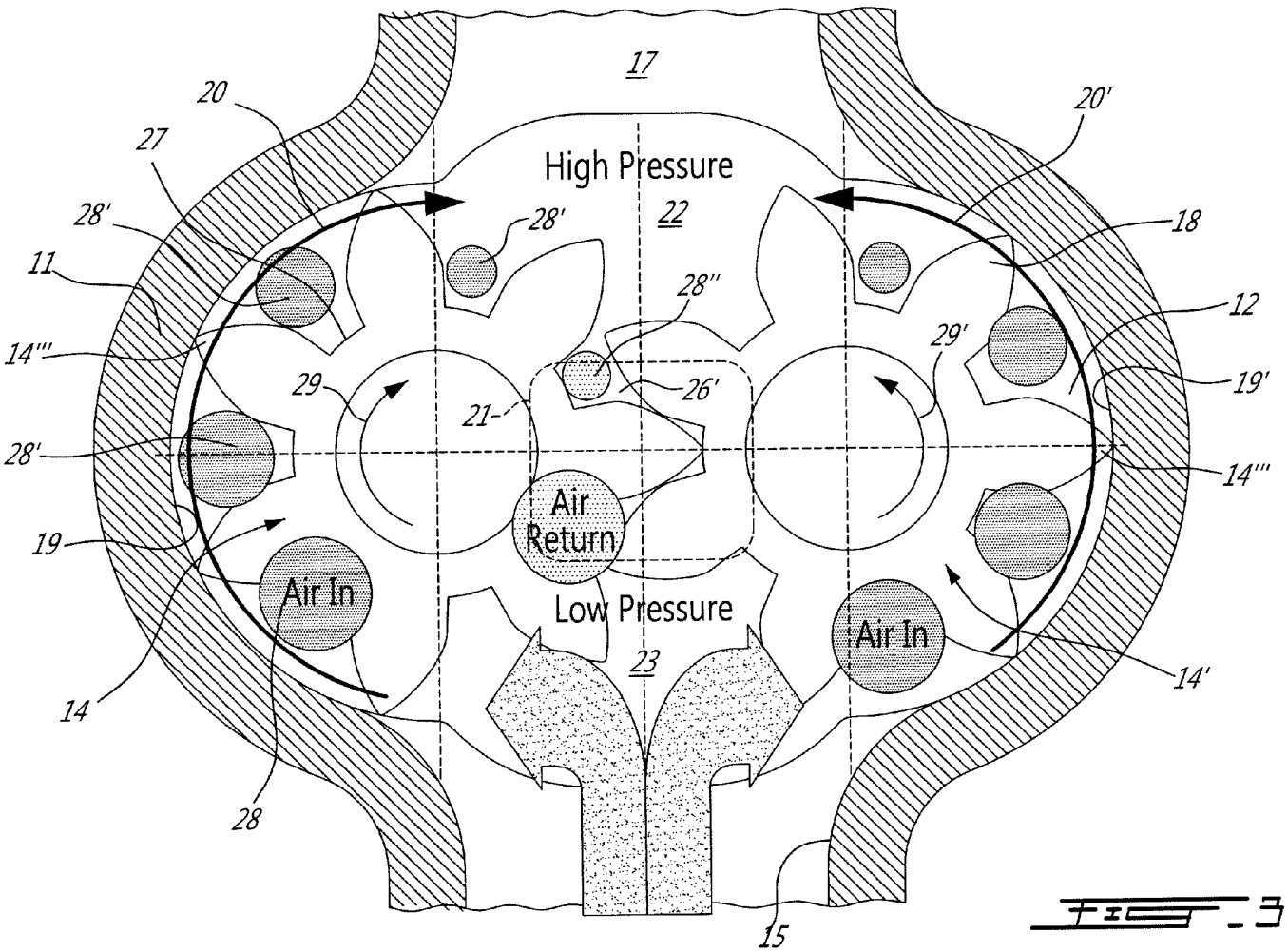
FIG. 3 is an enlarged fragmented section view illustrating how the volumetric capacity and efficiency of a scavenge gear pump is affected by air bubbles being displaced from the high pressure outlet area of the pump to the inlet low pressure area of the pump.

Referring now to FIGS. 1 to 3, there is shown generally at 10 a scavenge gear pump. These pumps are used for all sorts of applications for pumping hydraulic oil, for example to operate machinery implements or for use in turbine engine systems for pumping an air/oil mixture from an oil sump from a jet engine, or from an airframe or engine mounted gearboxes. The gear pump comprises a pump housing 11 having a pump chamber 12 in which is rotatably mounted, on respective shafts 13, a pair of drivable toothed gears 14 and 14'. One of the gears, herein gear 14, is a drive gear while gear 14' which is coupled thereto is driven by the drive gear 14.

As better seen in FIGS. 2 and 3, the pump chamber 12 has an inlet passage 15 for receiving oil 16 which is herein an oil-air mixture, at low pressure and displaced by the toothed gears 14 to an outlet passage 17 for delivering the oil mixture at a higher pressure. As better seen in FIG. 3, the gears 14 and 14' have radially projecting gear teeth 18 which are disposed closely spaced to a respective one of opposed arcuate walls 19 and 19' of the pump chamber 12 to define opposed displacement paths as illustrated by arrows 20 and 20'. The gear teeth 18 of the pair of toothed gears 14 and 14' intermesh in a gear meshing area 21 which is herein identified by stippled lines and which area is located between the gears.

A downstream region 22 is defined in the pump chamber 12 between the outlet passage 17 and the gear meshing area 21. An upstream region 23 is defined between the inlet passage 15 and the gear meshing area 21. As shown, the gear meshing area is disposed between said inlet and outlet passages.

Figure 4B:
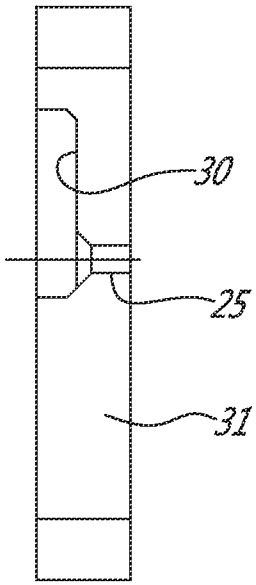
FIG. 4B is a cross-section view along cross-section lines A-A in FIG. 4A.
Figure 4A:
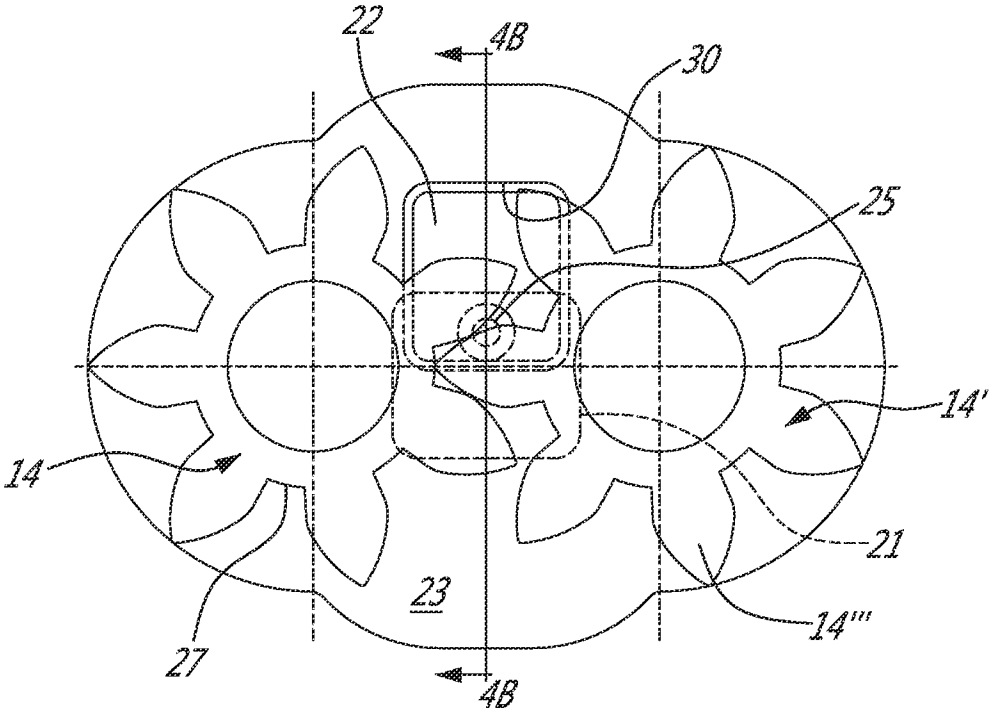
FIG. 4A is a schematic plan view illustrating the position of the oil injection nozzle and the relief cavity in the downstream region of the pump adjacent the gear meshing area.
Figure 5A:
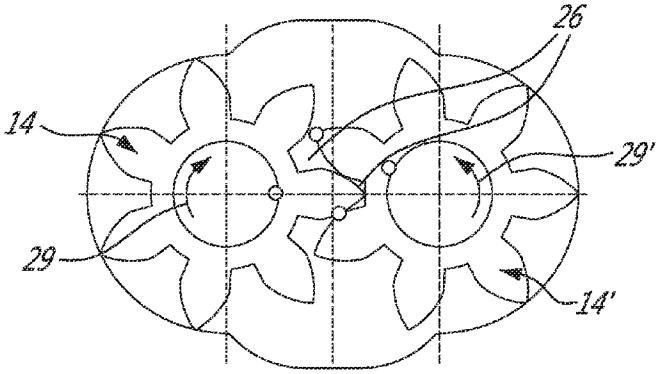
FIGS. 5A to 5D are plan section views illustrating the displacement of the toothed gears in the gear meshing area and the transfer of oil in the voids (volumes) formed by the meshing teeth of the gears from the high pressure downstream end to the low pressure upstream end of the pump.
Figure 5B:
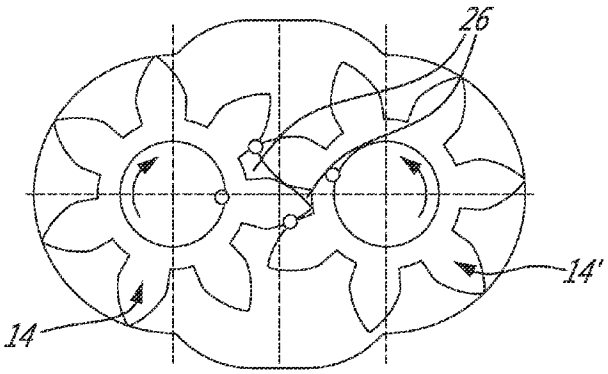
Figure 5C:
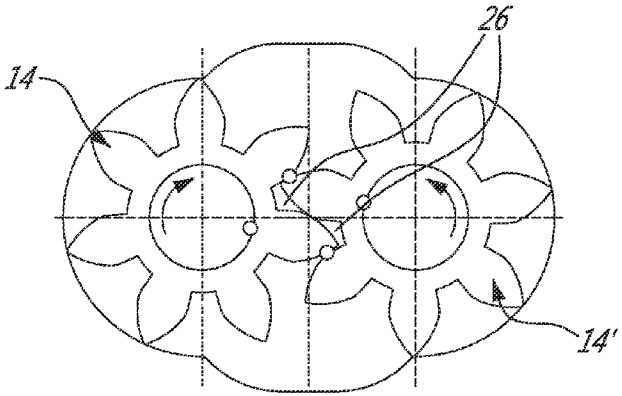
Figure 5D:
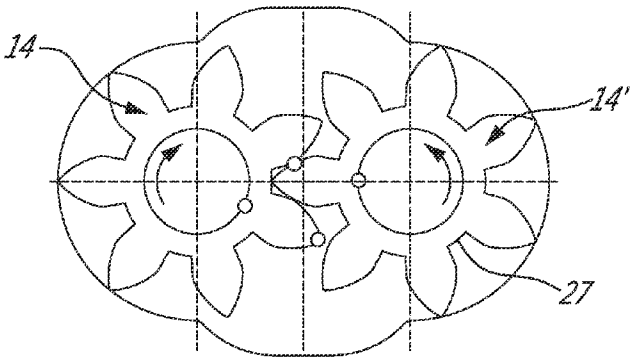

Referring now to FIGS. 4A and 4B, there is shown an oil injection passage 25 disposed in the downstream region 22 and positioned in relation to the gear meshing area 21 whereby to inject oil under pressure in the gear meshing area 21 at a rate to occupy substantially all voids or volumes 26, see FIGS. 5B and 5C, between the gear teeth 14 and 14' in the gear meshing area to prevent air bubbles in the downstream region 22 to be displaced back into the gear meshing area 21, where these air bubbles could occupy volume and cause the pump to stall. The oil injected under pressure in this region creates a barrier to the air trapped adjacent the outlet passage 17.

As also shown in FIGS. 4A and 4B, the oil injection passage 25 communicates with a relief cavity 30 which is machined or otherwise formed in a frontal wall 31 of the pump housing in the downstream region 22 and it is configured and disposed to surround a pre-meshing section 26' of the gear meshing area 21 to fill a voids between the intermeshing teeth in the gear meshing area.

The oil for the oil nozzle may be supplied from a gear pump outlet passage where the air bubbles have been separated from the oil, not shown, or an internal lubrication system of the gear pump, also not shown, or from a main oil pressure pump, not shown, but all of these are obvious to a person skilled in the art.

FIG. 3 illustrates a problem with these scavenge gear pumps when air is present in the oil mixture. As shown in FIG. 3, the typical scavenge gear pump carries an air-oil mixture, 1 to 3 volume of air for each 1 volume of oil. The oil mixture separates in the pump due to the centrifugal forces created by the high speed of rotation of the toothed gears 14 and 14' and the oil is released at the tooth tips of the teeth 14''' while the air forms a bubble or bubbles which are directed towards the gear hub 27. As hereinshown, the air bubble 28 entering the pump chamber 12 is at low pressure and as the gears rotate, the pressure increases by the forces applied by the speed of rotation of the gears and the air bubble is compressed, as shown by bubbles 28', as it is carried to the downstream region 22. Because the gears are operating in counter-rotation as shown by arrows 29 and 29', often these compressed air bubbles, such as the air bubble 28'', become trapped in the volumes or spaces 26 in the gear meshing area 21 and are carried back to the upstream area 23 of the pump, thus occupying space in that area as the air volume of the bubble expands in that area due to its transfer from a high pressure area to a low pressure area. Thus, the efficiency of the pump is reduced due to the air build-up in the upstream area 23 of the pump.

For the typical scavenge gear pump, the gear geometry creates gear meshing volumes of which is approximately 15%. An ideal pump with zero leakage will stop transferring any volume at a pressure ratio of less than 7 as the typical 15% volume of air returned from the downstream region expands to 105% upstream thus reversing the flow through the pump. At a pressure ratio of 4.5, the effective pump displacement is only 32.5%=100%−4.5×15%. The oil flow rate in the nozzle 25 amounts to 15% of the pump capacity in order to fill the volumes 26 between the intermeshing teeth. This oil is carried to the upstream region 23 of the pump and retains the same volume which is incompressible. The ideal zero leakage pump will pump against any adverse pressure ratio as the return oil volume does not change with the pressure and the effective pump capacity remains 100% at any pressure ratio. The leakages in an actual pump will therefore limit the maximum back pressure. However, the oil injected in the gear meshing area does not add to the existing pump leakage as it feeds the same leakage paths. The advantage of injecting oil in the high pressure downstream region is to prevent the pump to stall and re-prime itself due to this air transfer. Because the volumetric capacity is unaffected by back pressure, this now allows for the design of smaller pumps due to the fact that we do not have to account for air being returned to the low pressure side of the pump. Also, the oil tank is better pressurized as well as the installation of coolers in the scavenge line without having to resort to special cooler designs.

In summary, the present application also teaches a method of increasing the volumetric efficiency and back pressure of a scavenge gear pump by injecting oil under pressure in a downstream region of the pump adjacent the gear meshing area to substantially prevent the ingress of air bubbles in that area. Therefore, only oil is displaced by the intermeshing gears of the pump to an upstream region of the pump where an oil-air mixture enters the pump at an inlet thereof to be pressurized to the downstream region where the pump outlet is provided.

The provision of the oil injection passage provides for a scavenge gear pump having increased volumetric efficiency and which is more tolerant to back pressure. The pump can operate at increased volumetric efficiency and increased back pressure. The size of the pump can be reduced by substantially eliminating the transfer of air bubbles between the downstream region to the upstream region of the pump.

The above description is meant to be exemplary only, and one skilled in the art will recognize that changes may be made to the embodiment described therein without departing from the scope of the disclosure. It is therefore intended to cover any obvious modifications provided that these modifications fall within the scope of the appended claims.

What is claimed is:

1. A scavenge gear pump, comprising:

a pump housing defining a pump chamber, an inlet passage, an outlet passage, and a fluid injection passage, said inlet passage and said outlet passage and said fluid injection passage, respectively, being in fluid communication with the pump chamber, said inlet passage receiving an admixed fluid at low pressure in which the admixed fluid includes a first fluid admixed with a second fluid, said outlet passage receiving said admixed fluid at high pressure from a downstream region of said pump chamber for output external to said scavenge gear pump, said fluid injection passage being disposed in the downstream region of said pump chamber, and said fluid injection passage receiving a third fluid at an injection pressure for input into the pump chamber, a pair of driveable gears disposed in the pump chamber which respectively include outward projecting, radially disposed teeth which are configured to intermesh in a gear meshing area disposed intermediate the pair of driveable gears in the pump chamber during operation of said scavenge gear pump, wherein the third fluid is injected directly into the gear meshing area of the pump chamber through the fluid injection passage during said operation of the scavenge gear pump so that the third fluid fills voids at least between said intermeshing teeth of the pair of driveable gears disposed in the gear meshing area such that said second fluid, which is admixed with at least one of said first fluid and said third fluid contained within the downstream region of said pump chamber, does not occupy the gear meshing area.

2. The scavenge gear pump according to claim 1, wherein said first and said third fluid, respectively, are oil, and said second fluid is air.

3. The scavenge gear pump as claimed in claim 2 wherein the third fluid is injected directly into the gear meshing area by a fluid injection nozzle supplied with oil from the outlet passage.

4. The scavenge gear pump as claimed in claim 1 wherein said fluid injection passage communicates with a relief cavity formed in an inner surface of the pump housing, said relief cavity being in direct communication with said pump chamber in said downstream region, said gear meshing area overlying at least a portion of the relief cavity so that the third fluid fill voids between said intermeshing teeth in said gear meshing area.

5. The scavenge gear pump as claimed in claim 1 wherein said one of said pair of driveable gears is a drive gear, the other of said pair of driveable gears being driven by said drive gear in toothed engagement therewith, said gear meshing area being aligned between said inlet passage and said outlet passage.

6. The scavenge gear pump as claimed in claim 1 wherein said scavenge gear pump is an oil pump associated with a turbine engine system for pumping an air/oil mixture constituting said first fluid and said second fluid from an oil pump of a jet engine or from an airframe or engine mounted gearboxes.

7. The scavenge gear pump according to claim 1, wherein the fluid injection passage injects the third fluid at a flow rate of about 15% of a flow rate capacity of said gear pump.

8. A method of increasing the volumetric efficiency and back pressure of a scavenge gear pump, comprising: compressing an air-oil mixture via intermeshing driveable gears disposed in a pump chamber of said scavenge gear pump, and injecting oil under pressure directly in a gear meshing area of said intermeshing driveable gears in a downstream region of said pump chamber to substantially prevent the ingress of air bubbles that are present in the downstream region of said pump chamber into said gear meshing area, the injection of oil under pressure resulting in substantially only oil being displaced by the intermeshing driveable gears.

9. The method as claimed in claim 8 wherein the intermeshing driveable gears include a pair of driveable gears rotatably mounted in the pump chamber, said pump chamber having an inlet passage for receiving the air-oil mixture at a low pressure and an outlet passage for delivering said air-oil mixture at a higher pressure, wherein said air-oil mixture is displaced by said pair of driveable gears in opposed displacement paths, at least some of said compressed air being confined in the downstream region and prevented from migrating to said gear meshing area by said oil under pressure injected in said gear meshing area.

10. The method as claimed in claim 9 wherein there is further provided forming a relief cavity in an inner surface of the pump housing, said relief cavity being in direct communication with said pump chamber in said downstream region and disposed to overlie with said gear meshing area, an oil injection passage being in communication with said relief cavity, said oil under pressure being injected through said oil injection passage into said relief cavity.

11. The method as claimed in claim 9 wherein each of said pair of driveable gears has projecting gear teeth disposed proximate to a respective one of opposed arcuate walls of said pump chamber, said gear teeth intermeshing to define said gear meshing area.

12. The method as claimed in claim 8 wherein said oil under pressure injected in the gear meshing area amounts for about 15% of a flow rate capacity of said gear pump.

* * * * *